US005954136A

United States Patent [19]

McHugh et al.

[11] Patent Number: 5,954,136

[45] Date of Patent: Sep. 21, 1999

[54] METHOD OF SUSPENDING AN ESP WITHIN A WELLBORE

[75] Inventors: Marcus D. McHugh; Howard A. Oswald, both of Lawrence, Kans.

[73] Assignee: Camco International, Inc., Houston, Tex.

[21] Appl. No.: 08/937,844

[22] Filed: Aug. 25, 1997

[51] Int. Cl.[6] ..... E21B 19/00

[52] U.S. Cl. ..... 166/384; 166/385; 166/77.2

[58] Field of Search ..... 166/384, 385, 166/378, 66.4, 77.2, 68

[56] References Cited

U.S. PATENT DOCUMENTS

| | | | |
|---|---|---|---|
| 3,835,929 | 9/1974 | Suman, Jr. . | |
| 4,336,415 | 6/1982 | Walling . | |
| 4,346,256 | 8/1982 | Hubbard et al. . | |
| 4,681,169 | 7/1987 | Brookbank, III . | |
| 4,830,113 | 5/1989 | Geyer . | |
| 5,145,007 | 9/1992 | Dinkins . | |
| 5,146,982 | 9/1992 | Dinkins . | |
| 5,180,014 | 1/1993 | Cox . | |
| 5,191,173 | 3/1993 | Sizer et al. . | |
| 5,193,614 | 3/1993 | Cox . | |
| 5,269,377 | 12/1993 | Martin . | |
| 5,350,018 | 9/1994 | Sorem et al. | 166/187 X |
| 5,435,351 | 7/1995 | Head . | |
| 5,626,192 | 5/1997 | Connell et al. | 166/66.5 X |

*Primary Examiner*—Roger Schoeppel

[57] ABSTRACT

A method of suspending an electric submergible pumping system within a wellbore includes inserting an electric cable within a conduit, such as coiled tubing. An electric submergible pumping system is connected to the conduit, and the electric cable is connected to an electric motor of the electric submergible pumping system. The electric submergible pumping system and the conduit are inserted into the wellbore, and the electric cable is permitted to buckle in a manner so that the electric cable buckles and contacts an interior surface of the conduit at a plurality of locations to prevent longitudinal movement of the electric cable within the conduit. Since the cable is self supported within the conduit, there is no need for cable anchors or other devices to transfer the weight of the cable to the conduit.

18 Claims, 2 Drawing Sheets

METHOD OF SUSPENDING AN ESP WITHIN A WELLBORE

BACKGROUND OF THE INVENTION

1. Field of the Invention

The present invention relates to methods and related components for suspending an electric submergible pumping system ("ESP") within a wellbore and, more particularly, to methods and related components for disposing an electric power cable within a conduit to which is attached the ESP.

2. Description of Related Art

To reduce the size of equipment and the associated costs needed to deploy and recover an electric submergible pumping system ("ESP") within a wellbore, ESP's can be suspended from coiled tubing, rather than conventionaljointed tubing. This method takes advantage of the relatively low cost and ease of transportation of the units used to install and remove coiled tubing. Typical arrangements for suspending an ESP on coiled tubing are disclosed in U.S. Pat. Nos. 3,835,929; 4,830,113; and 5,180,014.

The electric power cable that is used to connect an electric motor of the ESP to a surface power source does not have sufficient internal strength to support its own weight over about twenty (20) feet. Therefore, the cable is clamped, banded or strapped to the outside of the jointed tubing or the coiled tubing at intervals, as disclosed in U.S. Pat. No. 4,681,169. Alternatively, the cable can be disposed within the coiled tubing, as disclosed in U.S. Pat. Nos. 4,336,415; 4,346,256; 5,145,007; 5,146,982; and 5,191,173.

When the cable is disposed within the coiled tubing, standoff devices are often used to centralize the cable within the coiled tubing. These prior standoff devices also support the cable, in place of the prior external clamps or straps, by preventing longitudinal movement of the cable with respect to the coiled tubing and thereby transfer the weight of the cable to the coiled tubing. These standoff devices are usually referred to as cable anchors, and examples thereof are disclosed in U.S. Pat. Nos. 5,193,614; 5,269,377; and 5,435,351.

Common problems associated with cable anchors are as follows. The cable and the coiled tubing have very different coefficients of thermal expansion, so that when the cable thermally expands after exposure to well conditions it is rigidly held by the cable anchors, and as such stress-related failures occur within the cable. Some prior cable anchors are relatively mechanically complex, and require injection of a solvent to release and set the anchors. Some cable anchors require a time consuming and uncontrollable chemical interaction to cause elastomeric materials on the cable or in the cable anchors to swell, and thereby frictionally engage the interior of the coiled tubing. Also, cable anchors tend to slip over time, so the cable extends longitudinally, which can damage or break the copper conductors. When coiled tubing has been used several times, it tends to no longer retain its circular cross-section but becomes slightly flattened or "oval" in shape. Internal cable anchors used in this oval coiled tubing have tendency to not consistently lock in place. In addition, the cable will be compressed against the lowermost electrical connector. This cable compression has caused electrical connectors to fail, necessitating the costly removal of the ESP from the well. Compounding the problem, the cable anchors often are very difficult to release to permit the removal of the cable from the coiled tubing.

There is a need for a simple method and related components for quickly and predictably disposing an electric power cable within a conduit, such as coiled tubing, that does not need cable anchors or other devices to transfer the weight of the cable to the conduit.

SUMMARY OF THE INVENTION

The present invention has been contemplated to overcome the foregoing deficiencies and meet the above described needs. Specifically, the present invention comprises methods and related components for disposing an electric power cable within a conduit. In one preferred method of the present invention, an electric cable is inserted into a conduit, such as coiled tubing, and an electric submergible pumping system is connected to the conduit, and the electric cable is connected to an electric motor of the electric submergible pumping system. The electric submergible pumping system and the conduit are inserted into the wellbore, and the electric cable is permitted to buckle in a manner so that the electric cable buckles and contacts an interior surface of the conduit at a plurality of locations to prevent longitudinal movement of the electric cable within the conduit. Since the cable is self supported within the conduit, there is no need for cable anchors or other devices to transfer the weight of the cable to the conduit.

DETAILED DESCRIPTION OF THE PREFERRED EMBODIMENTS

For the purposes of the present discussion, the methods and related components of the present invention will be described for example as relating to suspending an electric submergible pumping system ("ESP") on a conduit within a wellbore. It should be understood, however, that any type of conduit, tube or pipe can be used, such as coiled tubing, jointed tubing and the like, to suspend any type of wellbore equipment, such as logging tools, wireline tools, drilling tools, and the like, within a wellbore. Further, for the purposes of the present discussion, the methods and related components of the present invention will be described, for example, as relating to disposing an electric power cable within coiled tubing, which is connected to an ESP; however, it should be understood that the methods of the present invention can be used to disposing any type of cable, tube, conduit, cable, wire or rope within any type of conduit.

Figure 1:
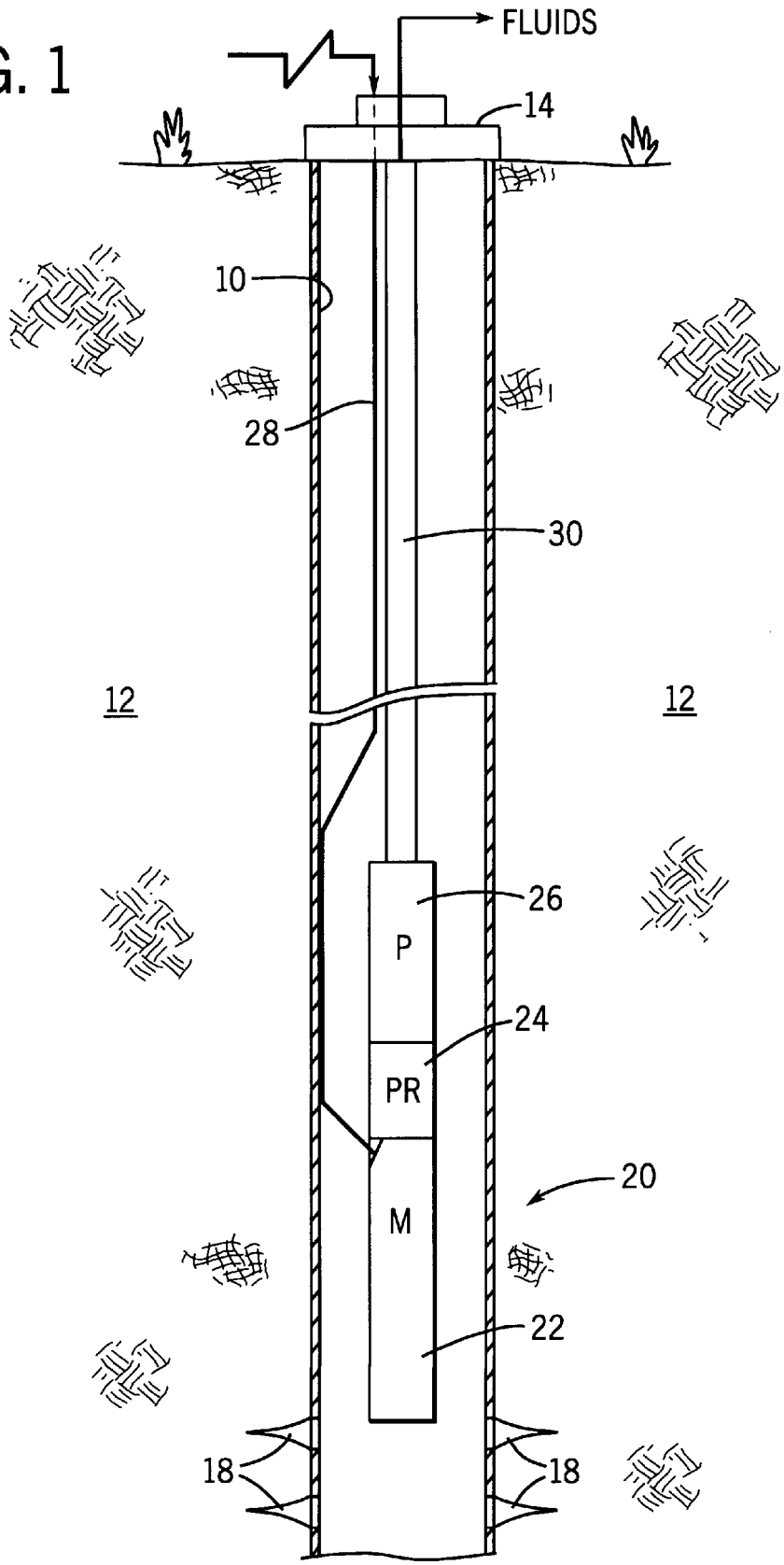
FIG. 1 is a partial cross-sectional view of a subterranean wellbore with an ESP suspended on a conduit therein, in accordance with one preferred method of the present invention.

To better understand the present invention, reference will be made to the accompanying drawings. FIG. 1 shows a wellbore 10, used for recovering fluids such as water and/or hydrocarbons, that penetrates one or more subterranean earthen formations 12. The wellbore 10 includes a wellhead 14 removably connected to an upper portion of a production tubing and/or casing string 16, as is well known to those skilled in the art. If the casing string 16 extends across a fluid producing subterranean formation 12, then the casing string 16 can include at least one opening or perforation 18 for permitting fluids to enter the interior thereof. An electric submergible pumping system ("ESP") 20 is shown suspended within the casing string 16, and generally includes an electric motor 22, an oil-filled motor protector 24, and a pump 26. The ESP 20 is shown in FIG. 1 in an upside-down arrangement with the motor 22 above the pump 26; however, it should be understood that the present invention can be used when the ESP 20 is deployed in a conventional configuration with the motor 22 below the pump 26.

For the purposes of this discussion, the terms "upper" and "lower", "above" and "below", "uphole" and "downhole", and "upwardly" and "downwardly" are relative terms to indicate position and direction of movement in easily recognized terms. Usually, these terms are relative to a line drawn from an upmost position at the surface of the earth to a point at the center of the earth, and would be appropriate for use in relatively straight, vertical wellbores. However, when the wellbore is highly deviated, such as from about 60 degrees from vertical, or horizontal, these terms do not make sense and therefore should not be taken as limitations. These terms are only used for ease of understanding as an indication of what the position or movement would be if taken within a vertical wellbore.

The ESP 20 is operatively connected to a lower end of a spool of coiled tubing 28 that has been spooled into the casing 16, as is well known to those skilled in the art. The coiled tubing 28 can be of any commercially available size (i.e. outside/inside diameter) and formed from any material suitable to the wellbore conditions, as all is well known in the art. For example, typical sizes of coiled tubing are from 0.75" OD to 3.5" OD, and are typically made from steel alloys.

A lower end of an electric cable 30 is operatively connected to the ESP 20 to provide electrical power to the electric motor 22, and an upper end is operatively connected at the earth's surface to electrical control equipment and a source of electrical power (both not shown), as are both well known in the art. Commercially available electric cable 30 typically used with ESP's 20 does not have sufficient internal strength to support its own freely suspended weight much past about twenty (20) feet; therefore, in the past a plurality of cable anchor assemblies were inserted within the coiled tubing. The prior cable anchor assemblies were used to transfer the weight of the cable to the coiled tubing.

Figure 2:
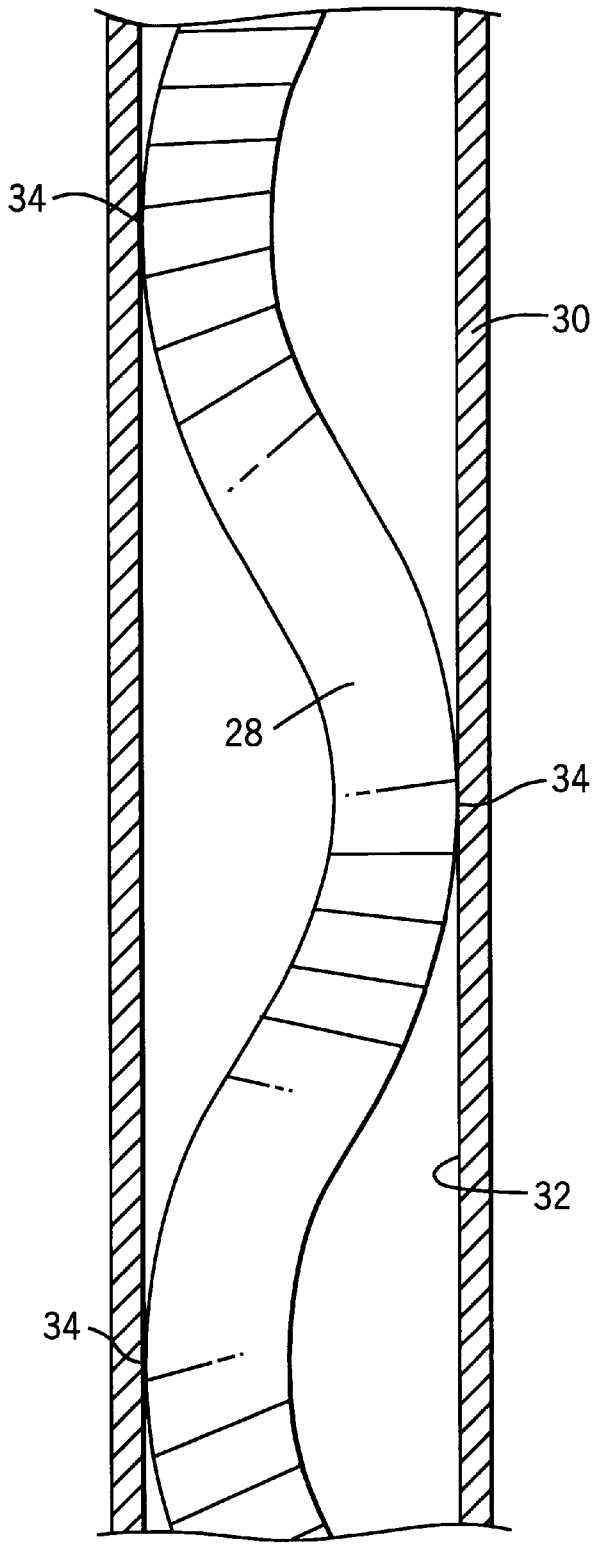
FIG. 2 is a cross-sectional view of an electric cable buckled within coiled tubing in accordance with one preferred method of the present invention.

As briefly described previously, the present invention does not use cable anchors, but instead relies on the concept of sizing the inside diameter of the coiled tubing 28, and the diameter of the electric cable 30, and choosing the internal strength or stiffness of the electric cable 30, all so that the electric cable 30 will purposefully "buckle" within the coiled tubing 28, and thereby be frictionally locked into position. As used herein the term "buckle" means having the electric cable 30 change its longitudinal alignment under compression from being coaxial with the coiled tubing 28 to being a spiral or helix, as shown in FIG. 2, with the electric cable 30 contacting an interior surface 32 of the conduit 30 at a plurality of spaced longitudinal locations 34. The cable buckling causes the weight of the electric cable 30, between the points of contact 34 with the coiled tubing 28, to be transferred as a compression frictional force to the coiled tubing 28. This frictional force prevents the electric cable 30 from further downward longitudinal movement within the coiled tubing 28, and so the cable 30 becomes self suspending within the coiled tubing 28.

The concept of "buckling" of the electric cable 30 is meant as a purposeful, designed arrangement, and not as the well known phenomenon of having the cable being damaged either by free suspension or excessive compressive forces. It is well known to those skilled in the art that if an electric power cable is held at the earth's surface and then allowed to be freely suspended within a wellbore, that the weight of the cable itself is greater than the internal strength of the cable to resist internal damage to the copper conductors and the insulation. Therefore, as mentioned above, electric cable has been banded or strapped to the outside of a conduit at intervals, such as every twenty (20) feet, or a plurality of internal cable anchors have been used to transfer the weight of the cable to the conduit. In the present invention, the cable 30 is not freely suspended, but has its weight transferred to the conduit at the plurality of points of contact 34 with the conduit 28.

Likewise, it is well known to those skilled in the art that if an electric power cable is not supported, then the weight of the cable at its lowermost point of contact, such as at the cable connector where the copper conductors are electrically connected to the ESP's electric motor, will be greater than the compressive strength of the cable itself, as well as the cable connector. In the present invention the lowermost end of the electric cable 30 is not subjected to damaging compressive forces, because the weight of the cable is transferred at a plurality of spaced locations to the conduit in a manner so as to prevent any downward longitudinal movement of the electric cable 30 within the coiled tubing 28.

Further, the term "buckling" includes the concept of carefully sizing the inside diameter of the coiled tubing 28 and the diameter of the electric cable 30, and choosing the internal strength of the electric cable 30, as will be described in detail below, so that the electric cable 30 will purposefully form the desired spiral or helical shape and make the plurality of points of contact 34 with the interior surface 32 of the coiled tubing 28 with sufficient compressive frictional forces to prevent downward longitudinal movement of the cable 30 within the coiled tubing 28.

In one preferred embodiment of the present invention, the cable 30 is inserted into the coiled tubing 28, such as coiled tubing, by any of the methods as described in the above referenced prior patents. This can take place during the manufacture of the coiled tubing or in the field. One preferred field method is to unspool the coiled tubing on the ground, run a guide wire there through, attach one end of the guide wire to the cable and attach the other end of the guide wire to a vehicle. The cable is coated with a friction-reducing agent, such as grease or oil, and the vehicle is then moved to pull the cable into the coiled tubing.

Once the cable 30 has been inserted into the coiled tubing 28, one end thereof, which will be the lowermost end adjacent the ESP 20, extends out from one end of the coiled tubing 28 and is sealed, such as by a pressure fitted connector and/or cap, as is well known to those skilled in the art. An upper end of the cable 30 is allowed to extend out from the coiled tubing 28 and is temporarily secured thereto. The ESP 20 is connected to the lower end of the coiled tubing 28, as is well known to those skilled in the art, and the lower end of the electric cable 30 is operatively connected to the motor 22. The ESP 20 is lowered into the wellbore 10, such as by the use of an injector head (not shown), as is well known to those skilled in the art.

The upper end of the cable 30 is controllably released during the installation procedure so as not to stretch or compress the cable 30. Once the ESP 20 is properly landed within the wellbore 10, the cable 30 is allowed to move downwardly within the coiled tubing 28 to form the desired spiral or helical shape. The cable 30 will then continually create the plurality of points of contact 34 with the interior surface 32 of the coiled tubing 28, and as such will transfer the compressive forces to the conduit 30. Limited compressive force may be applied to the cable 30 to ensure that the desired buckling of the cable 30 has occurred. After the cable 30 has settled within the coiled tubing 28, and no more downward movement of the cable 30 is detected, the upper end of the cable 30 is operatively connected to a source of electrical power, as is well known to those skilled in the art.

The sizing of the cable 30 and the coiled tubing 28 has been found to be important, as too small of a radial gap between the cable 30 and the interior surface 32 of the coiled tubing 28 will not permit the cable 30 to successfully buckle and the cable 30 will fall within the coiled tubing 28. Too large of a radial gap will not permit sufficient compressive frictional force to be transferred from the cable 30 to the coiled tubing 28, so that the cable 30 will fall within the coiled tubing 28. Likewise, the bending modulus or "stiffness" of the cable 30 must be carefully chosen, because if the cable 30 is too stiff, it will not successfully buckle.

For suspending an ESP 20 on coiled tubing 28, and to have proper buckling of the cable 30 within coiled tubing 28, the inventors hereof have found that the coiled tubing 28 preferably has an internal diameter of from about 2.0 inches to about 3.0 inches, that the cable 30 preferably has a diameter of from about 0.75 inch to about 2.0 inches, so that the radial gap is preferably from about 2.25 inches to about 0.5 inch. Further, the stiffness or bending modulus of the cable 30 is from about 100,000 psi to about 1,000,000 psi.

Mathematical modeling predicts that if the coiled tubing 28 and the cable 30 are properly sized so that proper buckling occurs, that the lower end of the cable 30 will be subjected to a non-damaging compressive load. For example, it was found that 5,000 feet of a 1.0 inch diameter 2/1 PPEO0.01305R cable has a bending modulus of about 150,000 psi and weigh about 5,610 lbs. When this cable is placed within a 2.0 to 2.5 inch internal diameter conduit, the cable will successfully buckle with a resulting compressive force measured at the lower end of the cable of only about 800 lbs. to 1,000 lbs.

Tests were made to ensure that a lower end of the cable can withstand the predicted 800–1,000 lbs. force The tests comprised taking a 28 inch length of the 1.0 inch diameter 2/1 PPEO 0.01305R cable and placing it into a vertical, three foot long length of 2.5 inch internal diameter coiled tubing. A constant compressive load of 3,000 lbs. was applied to the upper end of the cable for 18 hours. At the end of the test, the cable was examined and showed no signs of mechanical damage to the conductors or to the insulations.

As can be understood from the previous discussion, the present invention provides a novel method and related components for suspending an ESP within a wellbore using the concept of "buckling" the cable to therefore eliminate the need for and the problems with cable anchors or other devices to transfer the weight of the cable to the conduit.

Wherein the present invention has been described in particular relation to the drawings attached hereto, it should be understood that other and further modifications, apart from those from those shown or suggested herein, may be made within the scope and spirit of the present invention.

What is claimed:

1. A conduit for suspension within a wellbore, comprising:

a length of conduit; and electric cable disposed within the conduit in a manner so that the electric cable buckles and contacts an interior surface of the conduit at a plurality of locations to prevent longitudinal movement of the electric cable within the conduit.

2. A conduit of claim 1 wherein the electric cable directly contacts the interior surface of the conduit.

3. A conduit of claim 1 wherein the conduit comprises a plurality of lengths of jointed tubing.

4. A conduit of claim 1 wherein the conduit comprises a length of coiled tubing.

5. A conduit of claim 1 and further comprising an electric submergible pumping system operatively connected to one end of the electric cable.

6. A conduit of claim 5 wherein the electric submergible pumping system is connected to one end of the conduit.

7. A conduit of claim 1 wherein a compressive force on a lower end of the electric cable is less than a total weight of the electric cable.

8. A conduit of claim 1 wherein the electric cable buckles to form a helix within the conduit.

9. An electric submergible pumping system comprising:

a length of conduit for suspension within a wellbore;

a pump operatively connected to an electric motor, with the pump connected to one end of the conduit; and an electric cable disposed within the conduit in a manner so that the electric cable buckles and contacts an interior surface of the conduit at a plurality of locations to prevent longitudinal movement of the electric cable within the conduit.

10. An electric submergible pumping system of claim 9 wherein the electric cable directly contacts the interior surface of the conduit.

11. An electric submergible pumping system of claim 9 wherein the conduit comprises a plurality of lengths of jointed tubing.

12. An electric submergible pumping system of claim 9 wherein the conduit comprises a length of coiled tubing.

13. A method of installing an electric cable within a conduit, comprising:

(a) inserting an electric cable within a conduit; and (b) suspending the conduit and the electric cable in a manner so that the electric cable buckles and contacts an interior surface of the conduit at a plurality of locations to prevent longitudinal movement of the electric cable within the conduit.

14. The method of claim 13 and further comprising connecting an electric submergible pumping system to the one end of the conduit.

15. The method of claim 13 and further comprising operatively connecting the one end of the electric cable to an electric motor of the electric submergible pumping system.

16. The method of claim 13 wherein the conduit comprises a plurality of lengths of jointed tubing.

17. The method of claim 13 wherein the conduit comprises a length of coiled tubing.

18. A method of suspending an electric submergible pumping system within a wellbore, comprising:

(a) inserting an electric cable within a conduit;

(b) connecting an electric submergible pumping system to the one end of the conduit;

(c) operatively connecting the one end of the electric cable to an electric motor of the electric submergible pumping system;

(d) inserting the electric submergible pumping system and the conduit into the wellbore; and (e) permitting the electric cable to buckle within the conduit in a manner so that the electric cable buckles and contacts an interior surface of the conduit at a plurality of locations to prevent longitudinal movement of the electric cable within the conduit.

* * * * *